United States Patent [19]

Hösel et al.

[11] Patent Number: 4,813,616

[45] Date of Patent: Mar. 21, 1989

[54] METHOD AND APPARATUS FOR OPERATING A BALE OPENER AS A FUNCTION OF BALE LENGTHS

[75] Inventors: Fritz Hösel, Mönchengladbach; Josef Temburg, Jüchen, both of Fed. Rep. of Germany

[73] Assignee: Trützschler GmbH & Co., KG, Mönchengladbach, Fed. Rep. of Germany

[21] Appl. No.: 696,422

[22] Filed: Jan. 30, 1985

[51] Int. Cl.[4] ..... B02C 25/00

[52] U.S. Cl. ..... 241/36; 19/145.5; 241/101 A

[58] Field of Search ..... 241/33, 36, 101 A; 19/145.5; 83/71, 360

[56] References Cited

U.S. PATENT DOCUMENTS

| | | | |
|---|---|---|---|
| 1,172,058 | 2/1916 | Scheyer | 83/71 |
| 3,803,960 | 4/1974 | Pearl et al. | 83/71 X |
| 4,172,515 | 10/1979 | Wochnowski | 241/36 X |
| 4,187,990 | 2/1980 | Lundahl et al. | 241/101 A X |
| 4,357,737 | 11/1982 | Marx | 241/101 A X |
| 4,536,852 | 8/1985 | Hösel | 19/145.5 X |
| 4,544,106 | 10/1985 | Hackenbeck et al. | 241/101 A |
| 4,583,181 | 4/1986 | Gerber et al. | 83/71 X |
| 4,587,691 | 5/1986 | Hösel | 19/145.5 |

FOREIGN PATENT DOCUMENTS

| | | | |
|---|---|---|---|
| 1086976 | 8/1960 | Fed. Rep. of Germany | 241/30 |
| 370030 | 4/1973 | U.S.S.R. | 83/360 |

*Primary Examiner*—Howard N. Goldberg
*Assistant Examiner*—Joseph M. Gorski
*Attorney, Agent, or Firm*—Spencer & Frank

[57] ABSTRACT

A method of operating a bale opener having a carriage arranged for back-and-forth travel along a plurality of serially arranged fiber bales, a tower mounted on the carriage, a cantilever supported by the tower and projecting generally laterally therefrom, an opening device accommodated in the cantilever and arranged for removing fiber from bale tops, and a sensor arranged to travel in a path along the fiber bales. The method includes the steps of sensing the presence of a length boundary of the bales by the sensor and applying first signals, representing such presence, to a control device. The sensing step comprises the step of sensing the bale boundary by the sensor directly. The method further comprises the steps of determining positions of the sensor along its path of travel, applying second signals representing such positions to the control device, and comparing the first and second signals in the control device for determining locations of length boundaries of the bales along the path of travel of the bale opener.

6 Claims, 3 Drawing Sheets

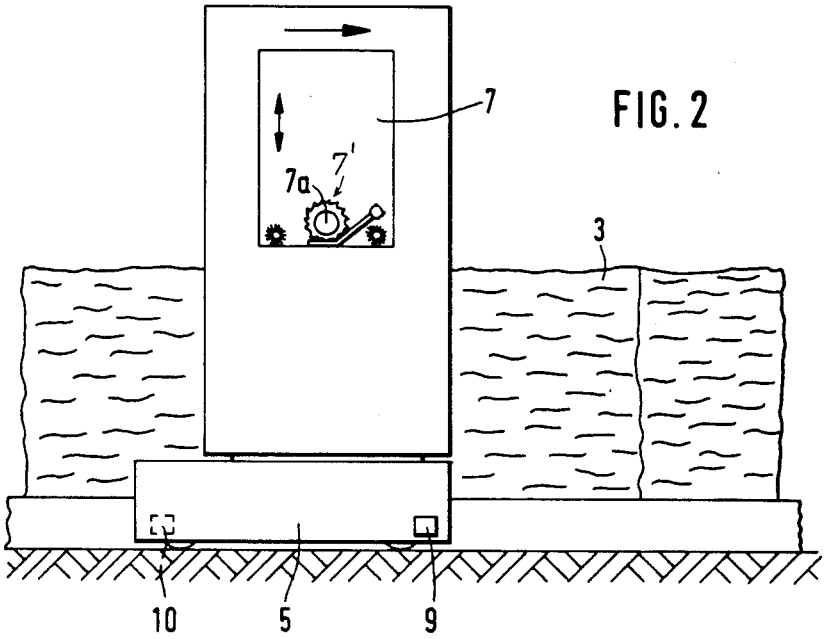
FIG. 2
FIG. 3
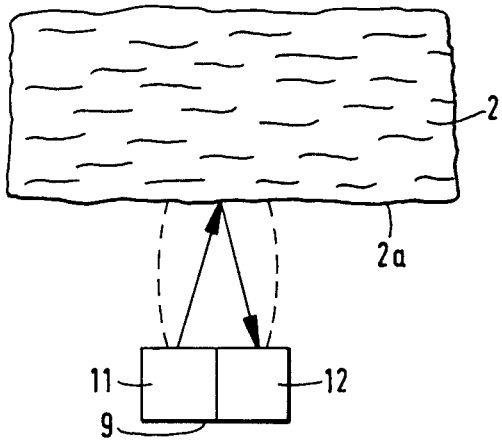

METHOD AND APPARATUS FOR OPERATING A BALE OPENER AS A FUNCTION OF BALE LENGTHS

RELATED PATENT

U.S. Pat. No. 4,536,852 issued Aug. 20, 1985 contains subject matter related to this invention.

BACKGROUND OF THE INVENTION

This invention relates to a method and an apparatus for operating a bale opener, particularly as a function of the length boundaries of the bales. The latter may be composed of cotton fiber, chemical fiber or the like. The opener has a carriage arranged for travel along a series of free-standing fiber bales. On the carriage there is mounted a tower which supports a vertically movable cantilever accommodating a rapidly rotating opening device. As the carriage and the tower travel, the opening device passes above the fiber bales for removing fiber from the top thereof. For determining the length boundaries of the bale series, a travelling sensor, upon traversing a bale boundary, transmits an electric signal which is applied to a control device.

In practice, a plurality of fiber bales are arranged in series and in a free-standing manner. When processing different types of fiber, groups of fiber bales may be set up with a space between the groups. The bales within each group contain the same type of fiber material. In order to be able to control the beginning and the end of fiber tuft removal from the bales, the length boundaries, that is, the position of the end faces of the bale series or, as the case may be, the bale groups, has to be determined. According to a known process, markings, such as metal riders are used which are arranged parallel to the fiber bales at the bale boundaries and may be manually shifted and set according to the particular mode of application. The metal riders are sensed by a travelling sensor whose electric signal is applied to the control device of the opener. It has been found in practice that a correct setting of the metal riders is often either overlooked or is not effected in an optimal manner. The consequence of such an oversight is often a drop in the production (since the travelling paths of the carriage are excessively long). Or, longer standstill periods result because an erroneous setting of the machine may cause jamming or an upsetting of the bales.

SUMMARY OF THE INVENTION

It is an object of the invention to provide a method and an apparatus of the above-outlined type from which the discussed disadvantages are eliminated and which, in particular, permits an automatic and reliable determination of the length boundaries of a bale series or bale group.

This object and others to become apparent as the specification progresses, are accomplished by the invention, according to which, briefly stated, the bale boundaries (that is, the locations of the vertical end faces of the bales) are determined directly by a sensor and further, the location of the sensor along its travelling path is determined by a measuring device and the electric signals transmitted by the sensor are applied to a control device or the measuring device and the electric signals of the measuring device are applied to the control apparatus.

According to the invention, the fiber bale boundaries, that is, the beginning and the end of the bale series or bale group is determined directly by a sensor. Further, the length of the travelling path of the sensor which is mounted on the carriage is determined by a measuring device. A combination of the electric signals of the sensor and the measuring device results in a measuring value for the position of the fiber bale boundaries and such a resultant signal is applied to the control apparatus which controls the beginning and the end of each opening pass. In this manner, an automatic and reliable determination of the boundaries of the bale series or bale group is achieved.

According to a further feature of the invention, the signals generated by the control device are applied to a memory; consequently, the measuring process has to be effected only once, that is, only at the beginning of the bale opening process. The determined measuring values are then stored and are available for each bale opening pass.

The apparatus for performing the process according to the invention includes a sensor mounted on the carriage of the bale opener for determining the bale boundaries and further, a measuring device is provided for determining the position of the carriage. The sensor is operatively connected with the control apparatus or the measuring device and the latter is connected with the control apparatus.

According to a further feature of the invention, the control device is connected with a memory. Preferably, the control device is coupled with an inputting device, for example, for inputting the fiber type quantities.

According to still another feature of the invention, two sensors are provided, one mounted on each side of the carriage oriented towards the bale series on both sides of the bale opener. The sensors are disposed at a relatively low level, so that even the lowest bale parts may be sensed thereby. Two sensors are required because, unlike the tower of the bale opener, the carriage does not turn between consecutive passes, it only reverses direction. It is feasible and even advantageous, however, to provide a single sensor which is mounted on a lateral surface, for example, of the tower or the cantilever. In this case a single sensor suffices because these components execute a 180° turn between each pass and therefore the sensor may be at all times oriented towards the fiber bales which are in the process of being opened. According to a further feature of the invention, a buffered memory is used to ensure that the stored information, such as the measuring values will not be lost if power supply is interrupted. Dependent upon the capacity of the memory it is feasible to simultaneously store information concerning the boundaries of both bale series on either side of the bale opener. In this manner, it is feasible to exchange working zones without a renewed measuring step.

BRIEF DESCRIPTION OF THE DRAWINGS

FIG. 2 is a schematic side elevational view of the preferred embodiment.

FIG. 3 is a diagrammatic view illustrating the operation of a component of the preferred embodiment.

DESCRIPTION OF THE PREFERRED EMBODIMENT

Figure 1A:
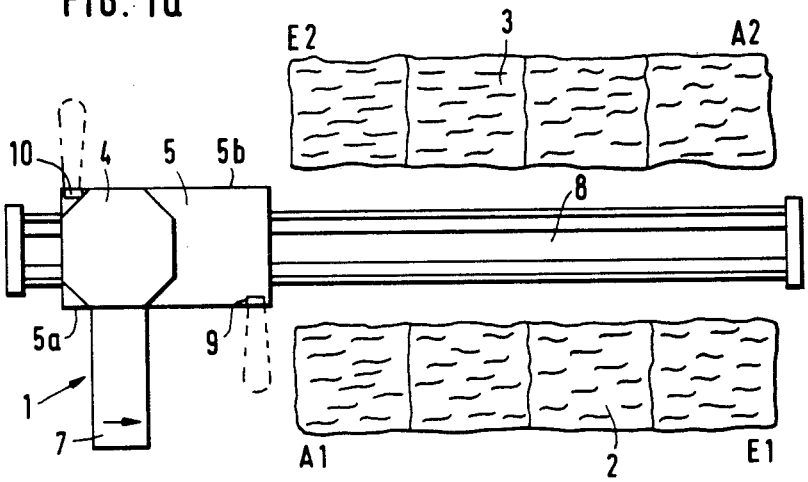
FIG. 1*a* is a schematic top plan view of a bale opener incorporating a preferred embodiment of the invention, illustrating a non-operating position.
Figure 1B:
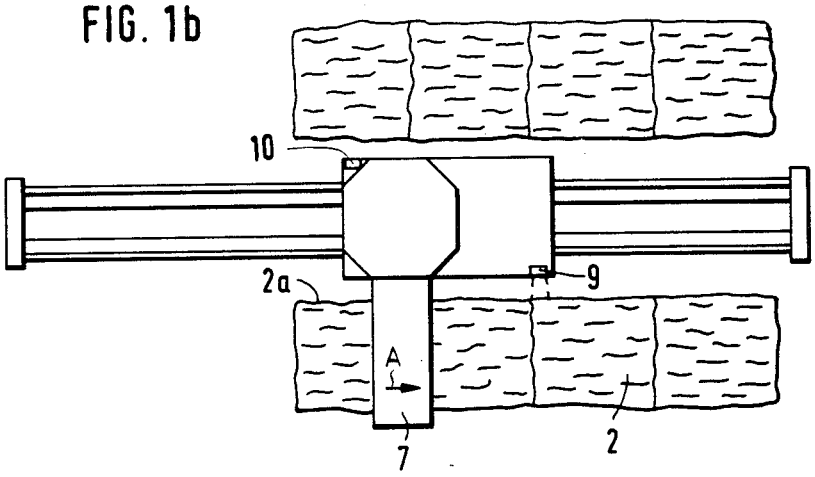
FIG. 1*b* is a view similar to FIG. 1*a*, illustrating an operating position.

Turning to FIGS. 1*a*, 1*b* and 2, there is illustrated therein a travelling bale opener which may be a "BLENDOMAT" model, manufactured by Trützschler GmbH & Co. KG, Mönchengladbach, Federal Republic of Germany, for removing fiber tufts from the top of fiber bale series 2 and 3 arranged on either side of the travelling path of the bale opener. The latter comprises a tower 4 which is mounted on a carriage 5 for rotation about a vertical axis. The carriage 5 has wheels for a back-and-forth travel along the fiber bale series. The tower 4 has on one side a cantilever 7 which houses a rapidly rotating opening device 7'. The cantilever 7 may be shifted vertically with respect to the tower 4 to adapt the opening device 7' to the momentary height of the fiber bales. The opening device 7' which may comprise, for example, a toothed opening roller 7*a*, removes fiber tufts from the upper face of the fiber bales of the bale series 2 and 3. Underneath the tower 4 there extends a duct 8 for receiving and pneumatically advancing the fiber tuft removed from the bales by the bale opening device. During operation, the carriage 5 and the tower 4 travel along the fiber bale series 2 and 3 whereby the cantilever 7 and the opening device 7' move, with the tower 4, back-and-forth above the free-standing fiber bale series 2 and 3. Starting from location A1 of the bale series 2, the opening device 7' travels to the end El (forward pass). At the location E1 the tower 4 and thus the cantilever 7 and the opening device 7' are rotated 180° about a vertical axis clockwise as viewed in FIG. 1*a*. Upon this occurrence, the opening device 7' assumes its initial position A2 of the bale series 3. From location A2 of the bale series 3 the carriage moves to the end E2 (return travel).

On a lateral surface 5*a* of the carriage 5 there is mounted a sensor 9 and on an opposite lateral surface 5*b* there is mounted a sensor 10. The sensors 9 and 10 may be infrared, ultrasonic, optical, capacitive or mechanical sensors. The sensors 9 and 10 are, as shown in FIG. 2, situated at a low location on the carriage 5 to be able to sense bales or bale remnants of the smallest possible height.

According to FIG. 1*a*, the cantilever 7 is situated externally of the zone of the bale series 2. The sensing range of the sensors 9 and 10 is indicated in broken lines. In FIG. 1*b*, the cantilever 7 is shown to be situated above the bale series 2 and is in the process of travelling in the direction E1, as indicated by the arrow A. In front of the sensor 9—which is the operative sensor for that pass—there is situated the lateral face 2*a* of the bale series 2 that is, the bale series 2 is in the operating range of the sensor 9 as a result of which, as shown in FIG. 3, beams emitted by the source 11 of the sensor 9 are reflected by the lateral face 2*a* and enter the detector 12 of the sensor 9. At the moment the sensor 9 moves past the bale boundary A1—that is, when the sensor moves from "light" to "dark"—the sensor 9 transmits a signal. The sensor 9 behaves similarly upon passing the opposite boundary E1—that is, when the sensor moves from "dark" to "light".

Figure 4:
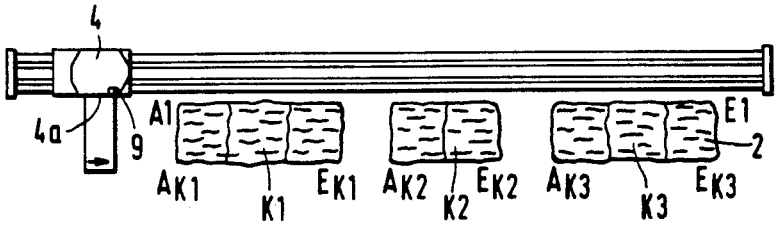
FIG. 4 is a schematic top plan view of the preferred embodiment, illustrating the arrangement of three fiber bale groups.

Turning now to FIG. 4, the bale series 2 is formed of three bale groups K1, K2 and K3. Each group is composed of a plurality of fiber bales and further, each group is formed of one type of fiber material different from group to group. Thus, in the bale series 2, three fiber types (assortments) are present. The beginning and the end of each group are designated as follows: $A_{K1}$ and $E_{K1}$ is the beginning and the end, respectively, of group K1, $A_{K2}$ and $E_{K2}$ is the beginning and the end, respectively, of group K2 and $A_{K3}$ and $E_{K3}$ designates the beginning and the end respectively, for group K3. Between the groups K1, K2 and K3, there is an intermediate space void of fiber material. The sensor 9 is situated on the side wall 4*a* of the tower 4.

Figure 5:
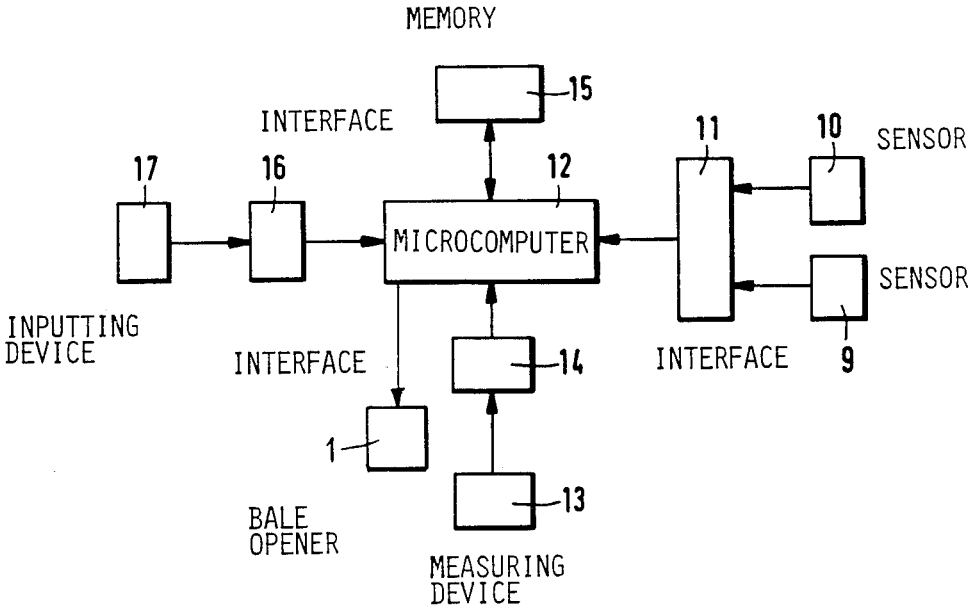
FIG. 5 is a block diagram of a circuit forming part of the preferred embodiment.

Turning now to FIG. 5, the sensors 9 and 10 are connected, with the intermediary of an interface 11, with a control apparatus 12 such as a microcomputer with a microprocessor. The control apparatus 12 may be a TMS model microcomputer with a Rockwell 6502 micropocessor, manufactured by Trützschler GmbH & Co. KG, Mönchengladbach, Federal Republic of Germany. A measuring device 13 is connected with the intermediary of an interface 14 with the control apparatus 12 for determining the position (X-axis) of the carriage 5. Further, the control apparatus 12 is connected with the intermediary of an interface 16 with an inputting device 17, for example, for inputting the fiber type. The control apparatus 12 is also connected with a memory 15.

By means of the inputting device 17 the control apparatus 12 is informed of the quantity of fiber types in the working range A1 to E1 or A2 to E2 of the bale series 2 or 3, respectively. Thereafter, the carriage 5 is moved to the beginning A1 of the working range of the bale series 2. Therefrom, the carriage 5 moves towards the end E1 along the bale series 2. As soon as the first bale encountered by the opening device 7' arrives in the operational ranges of the sensor 9, the latter transmits a signal to the control apparatus 12 which asks, by means of the measuring device 13, the momentary position of the carriage 5 and transmits to the memory 15 the obtained value as a beginning A1 of the bale series 2 which is, at the same time, the beginning $A_{K1}$ of the first fiber assortment K1. The sensor 9 continues to transmit a signal to the control apparatus 12 as long as the presence of a bale is sensed. At the moment the absence of bale is sensed, the control apparatus 12 again determines the position of the carriage 5 and applies the obtained information to the memory 15. Dependent upon the quantity of fiber types in the work zone A1 to E1 it is then either the end E1 of the bale series 2 (in case of only a single fiber type) or the end $E_{K1}$ of the first assortment K1, in case of two or more fiber types K1 through K3. In case more than one fiber type is used (as illustrated in FIG. 4), the carriage 5 moves further towards the end El until the beginning of the consecutive fiber assortment (fiber bale group) K2 or K3 is reached, the position of the carriage 5 is determined and the information stored in the memory 15. The same process is performed at the end of each fiber bale group (fiber type) until the end E1 of the bale series 2 is reached. Upon such an occurrence, all starting and terminal values are present in the memory 15 and may be called therefrom for an accurate representation of the position of the bale series, required for the opening process.

The determined starting and/or terminal values may be provided with a correction factor. Upon determining the end of one bale group K1, K2 or K3 by means of the sensor 9, it is conceivable that the opening device 7' is still in engagement with the last bale of that group so that, for example, a lowering of the cantilever 7 is not yet possible. Such lowering may occur only after the carriage 5 has moved a certain distance further, that is, the actual value is increased or reduced by, for example, 500 mm.

It is further feasible to operate the bale opener in such a manner that the control apparatus 12 is not inputted in advance concerning the quantity of assortments K1 through K3 in the working range (Al-EI and A2-E2). In such a case, the carriage 5 travels towards the end of the working zone until it reaches the same. Upon this occurrence, retroactively the end of the last fiber group is declared to be the end of the entire bale series.

It will be understood that the above description of the present invention is susceptible to various modifications, changes and adaptations, and the same are intended to be comprehended within the meaning and range of equivalents of the appended claims.

What is claimed is:

1. In a bale opener including a carriage arranged for back-and-forth travel in a travelling path along a plurality of serially arranged consecutive fiber bales, a tower mounted on the carriage; a cantilever supported on said tower and extending laterally therefrom; an opening device accommodated in said cantilever and arranged for removing fiber from bale tops; the improvement comprising:

(a) sensor means, mounted on said bale opener, for generating first signals representing a presence of a gap between two consecutive bales;

(b) a measuring means for generating second signals representing positions of said carriage during the back-and-forth travel thereof;

(c) a control means, operatively connected to said sensor means and said measuring means, for receiving said first and second signals and for determining, from a combination thereof, a measuring value representing a position of the gap along said travelling path; and (d) memory means, connected to said control means, for storing said measuring value therein and for releasing said measuring value to said control means; said control means being connected to said bale opener for operating said bale opener as a function of the measuring value released to said control means.

2. A bale opener as defined in claim 1, wherein said sensor means comprises a single sensor mounted on a lateral face of said cantilever.

3. A bale opener as defined in claim 1, further comprising an inputting device connected to said control means.

4. A bale opener as defined in claim 3, wherein said sensor means comprises two sensors mounted on opposite lateral sides of said carriage.

5. A bale opener as defined in claim 1, wherein said sensor means comprises a single sensor mounted on a lateral face of said tower.

6. A bale opener as defined in claim 1, wherein said memory means compress memory means.

* * * * *